US006856082B2

(12) United States Patent
Suzuki et al.

(10) Patent No.: US 6,856,082 B2
(45) Date of Patent: Feb. 15, 2005

(54) CATHODE RAY TUBE WITH PANEL PROVIDED WITH COLORED LAYER

(75) Inventors: Atsushi Suzuki, Chiba (JP); Masahiro Yamamura, Osaka (JP); Yasunori Miura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/902,972

(22) Filed: Jul. 11, 2001

(65) Prior Publication Data

US 2002/0008460 A1 Jan. 24, 2002

(30) Foreign Application Priority Data

Jul. 24, 2000 (JP) ..... 2000-222299

(51) Int. Cl.[7] ..... H01J 29/10

(52) U.S. Cl. ..... 313/461; 313/477 R; 313/478; 313/479; 313/480; 313/112

(58) Field of Search ..... 313/461, 477 R, 313/478, 479, 480, 112

(56) References Cited

U.S. PATENT DOCUMENTS

| | | | | |
|---|---|---|---|---|
| 4,025,661 A | * | 5/1977 | Moscony et al. | 427/68 |
| 4,682,075 A | * | 7/1987 | Nelson et al. | 313/466 |
| 5,446,339 A | * | 8/1995 | Kinoshita et al. | 313/478 |
| 5,863,596 A | | 1/1999 | Kojima et al. | 427/64 |
| 5,952,137 A | * | 9/1999 | Ihara et al. | 430/27 |
| 6,066,914 A | | 5/2000 | Shimizu et al. | 313/477 R |
| 6,114,803 A | * | 9/2000 | Hosotani | 313/461 |
| 6,268,693 B1 | | 7/2001 | Miwa et al. | 313/479 |
| 6,356,012 B1 | | 3/2002 | Bae | 313/479 |

FOREIGN PATENT DOCUMENTS

| | | |
|---|---|---|
| CN | 1219749 | 6/1999 |
| EP | 0 272 689 | 6/1988 |
| EP | 1 156 509 | 11/2001 |
| JP | 11-233050 | 8/1999 |
| JP | 11-283530 | 10/1999 |
| JP | 11-288676 | 10/1999 |
| JP | 11-307016 | 11/1999 |
| KR | 97-64128 | 12/1997 |
| WO | WO00/44029 | 7/2000 |

* cited by examiner

*Primary Examiner*—Vip Patel
*Assistant Examiner*—Kevin Quarterman
(74) *Attorney, Agent, or Firm*—Merchant & Gould P.C.

(57) ABSTRACT

This is a cathode ray tube having a panel provided with a colored layer on an outer surface of a face portion, wherein an emission luminance ratio is 75% or higher in a lowest part relative to a highest part, and a diffuse reflectance ratio is 90% or higher in a lowest part relative to a highest part in an image display area of the face portion. Due to this configuration, a cathode ray tube with a natural appearance can be obtained in which a luminance difference or a contrast difference is not perceived in the entire area of the face portion.

9 Claims, 6 Drawing Sheets

CATHODE RAY TUBE WITH PANEL PROVIDED WITH COLORED LAYER

BACKGROUND OF THE INVENTION

1. Field of the Invention

The present invention relates to a cathode ray tube used for a computer monitor, a television receiver or the like, and the present invention relates particularly to a surface treatment technique thereof.

2. Description of the Related Art

Generally, with respect to a cathode ray tube, due to a thickness difference between the center and the periphery of the face portion for securing a vacuum pressure-resistant strength, or a phenomenon in which a width and a size or a film thickness condition of a phosphor stripe or a phosphor dot deteriorates as it approaches the periphery of the face portion, or also due to a color displacement of phosphors caused by the broadening of a deflection angle in the periphery of the face portion and so on, the face portion of the panel tends to have lower emission luminance in the periphery than in the center.

As measures against this, a technique is known in which a colored layer is formed on an outer surface of the face portion with a high density in the central portion and a low density in the peripheral portion of the face portion so as to allow the emission luminance of the cathode ray tube (luminance in the case of displaying the entire screen of the cathode ray tube with a certain signal) to be equal over the entire area of the face portion.

However, when the emission luminance is allowed to be equal over the entire area of the face portion by changing the density of the colored layer in this way, a darkness difference of the colored layer is increased between the center and the periphery of the face portion, so that a phenomenon is likely to occur in which the center is strangely darkened against the periphery, causing a contrast difference in images.

In particular, with respect to a cathode ray tube having a face portion whose outer surface is flat, which has been growing in demand in recent years, the periphery and the center of the face portion are located on the same plane, so that such a darkness difference of colors between the center and the periphery will be more noticeable.

SUMMARY OF THE INVENTION

The present invention is conceived in view of such a problem, and its object is to provide a cathode ray tube in which both the emission luminance and the distribution of contrast can be obtained most naturally over the entire face portion.

To achieve the above object, a cathode ray tube of the present invention is a cathode ray tube including a panel provided with a colored layer on an outer surface of a face portion, wherein an emission luminance ratio is 75% or higher in a lowest part relative to a highest part, and a diffuse reflectance ratio is 90% or higher in a lowest part relative to a highest part in an image display area of the face portion.

Due to this configuration, a cathode ray tube with a natural appearance can be achieved from which a luminance difference or a contrast difference is not perceived over the entire area of the face portion.

Furthermore, it is preferable in the cathode ray tube of the present invention that a light transmittance of the colored layer in a periphery of the face portion is the same as or larger than a light transmittance in a center.

Due to this configuration, a darkness difference of colors between the center and the periphery of the face portion can be suppressed.

In addition, it is preferable in the cathode ray tube of the present invention that the outer surface of the face portion is substantially flat and an inner surface thereof is curved, and that a light transmittance ratio of the colored layer is 100 to 120% in a peripheral portion on a minor axis of the face portion relative to a center.

Due to this configuration, a darkness difference of colors between the center of the face portion and the periphery on the minor axis can be suppressed.

Furthermore, a method for manufacturing a cathode ray tube of the present invention allows the colored layer to have a distribution of light transmittance by changing an application quantity of a coloring agent.

Due to this configuration, the distribution of light transmittance in the colored layer can be changed easily.

DETAILED DESCRIPTION OF THE INVENTION

Hereinafter, an embodiment of the present invention will be described with reference to the drawings.

Figure 2:
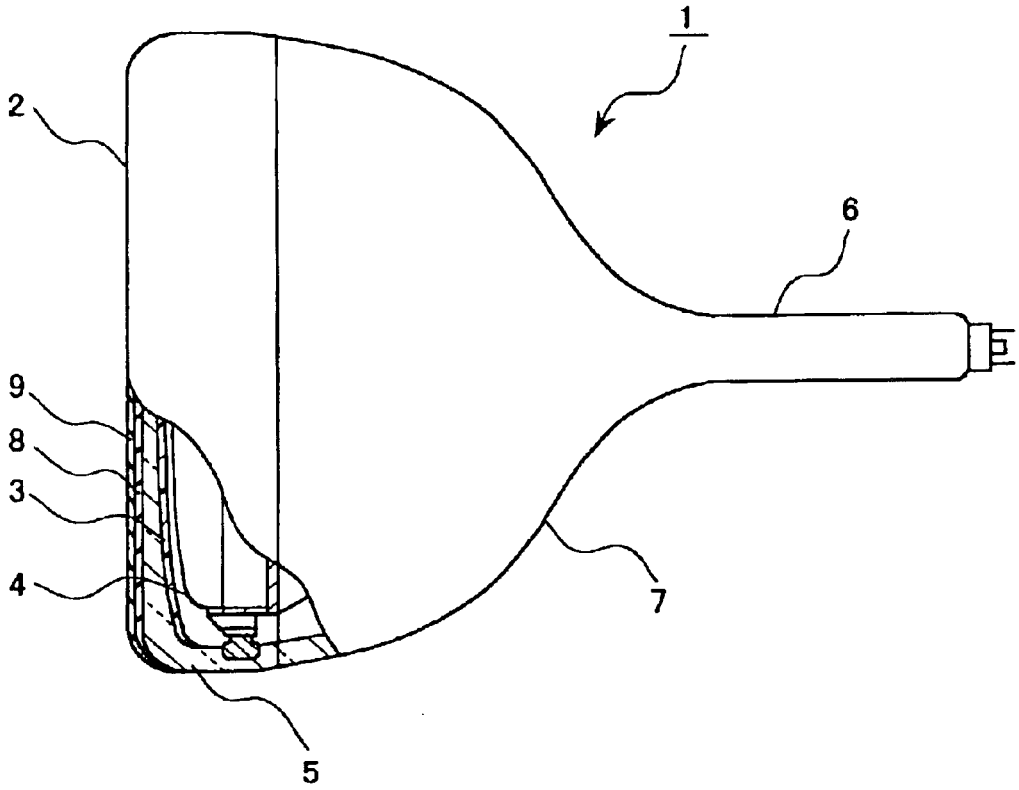
FIG. 2 is a partial cross-sectional view of the cathode ray tube according to the embodiment of the present invention.

FIG. 2 is a partial cross-sectional view of a cathode ray tube 1 according to an embodiment of the present invention, in which the envelope is constructed of a panel 5 provided inside with tube parts such as a shadow mask 4 and a funnel 7 equipped with an electron gun (not shown) inside a neck portion 6. A phosphor screen 3 is formed on an inner surface of a face portion 2 of the panel 5. The outer surface of the face portion 2 in this cathode ray tube 1 is substantially flat, and the inner surface is curved.

For the material of the panel 5, scarcely colored glass (an absorption coefficient k=0.01290) is used. On the outer surface of the face portion 2 in this panel 5, there is a colored layer 8 formed by a black coloring material mainly composed of carbon black as the first layer, and on top thereof, a silica layer 9 is formed as the second layer. The process of forming these layers is as follows.

First, the outer surface of the face portion 2 in the cathode ray tube 1 is polished by using an abrasive agent such as cerium oxide to remove any attached stain. Next, this abrasive agent is washed out thoroughly, and the surface is in a clean state. Then, the panel 5 is inserted into a preheating furnace constructed of an infrared heater or the like to heat up the outer surface of the panel. When the external temperature of the panel reaches about 60° C., by scanning a spray nozzle of a two fluid air atomizing type attached to a tip of a six-axial robot at an interval of a certain distance, a coloring agent of an alcoholic solution containing 1.0 weight percent of a solid mainly composed of carbon black is sprayed and applied from a nozzle, forming the colored layer 8 in the face portion 2. Here, when a metal particulate, a metal-oxide particulate, a pigment or the like is used as the coloring agent, the colored layer 8 that has excellent light resistance and heat resistance as well as less deterioration of the coloring effect can be formed.

Next, as the second layer on top of this colored layer 8, the silica layer 9 is formed by applying an alcoholic solution including ethyl silicate according to the spin coating method. The surface temperature of the panel at the time when the silica layer is applied is set to be about 40° C., and the panel is rotated at 70 revolutions per minute for 10 seconds when injecting the coating material and at 100 revolutions per minute for 90 seconds during equalization. Thereafter, the external temperature of the panel is maintained at 180° C. to burn for 30 minutes, and the silica layer is hardened.

Here, the colored layer featuring the present invention will be explained in detail.

When forming the colored layer 8, in order to allow the cathode ray tube 1 not to have a big difference in the emission luminance depending on the place of the face portion 2, the density (application quantity) of the coloring agent simply may be reduced in the part where the light transmittance of the single panel or the emission rate of the phosphor screen 3 is low, compared to the part where they are high. At this time, however, it is necessary not to allow a big darkness difference of colors to appear between the parts where the density of the coloring agent is high and low. In particular, with respect to the cathode ray tube having a face portion whose outer surface is flat, due to the fact that the periphery and the center of the face portion are located on the same plane, the darkness difference of colors between the center and the periphery will be more noticeable, so that the colored layer needs to be applied by taking this fact into consideration.

Figure 1:
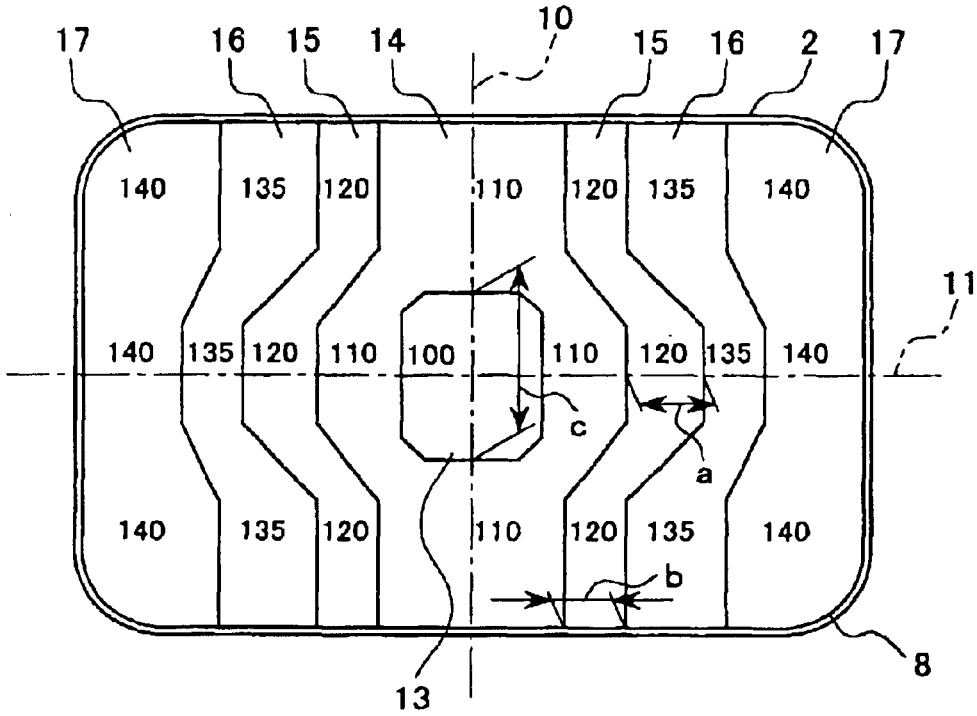
FIG. 1 is a distribution diagram of light transmittance ratios in a colored layer of a cathode ray tube according to an embodiment of the present invention.

In the present embodiment, the colored layer 8 formed on the outer surface of the face portion 2 is formed by changing the light transmittance thereof stepwise, and the application is conducted such that the boundary lines showing the distribution of this light transmittance form an approximate Ω letterform that protrudes toward the right and left peripheral sides in the vicinity of the major axis 11 in the face portion 2 as shown in FIG. 1 (the numbers in the drawing show the light transmittance ratio (unit: %) in each area relative to the center). In addition, when a width on the major axis 11 of each area in the colored layer 8 divided by each boundary line is a, a width on the longer side of the face portion 2 is b, and a height of an area 13 is c, the dimensions of each area are a=175 mm and c=200 mm in the area 13, a=75 mm and b=200 mm in an area 14, a=75 mm and b=50 mm in an area 15, and a=63 mm and b=100 mm in an area 16. Furthermore, an area 17 denotes the entire image display area on the right and left outer sides of the area 16.

Figure 3:
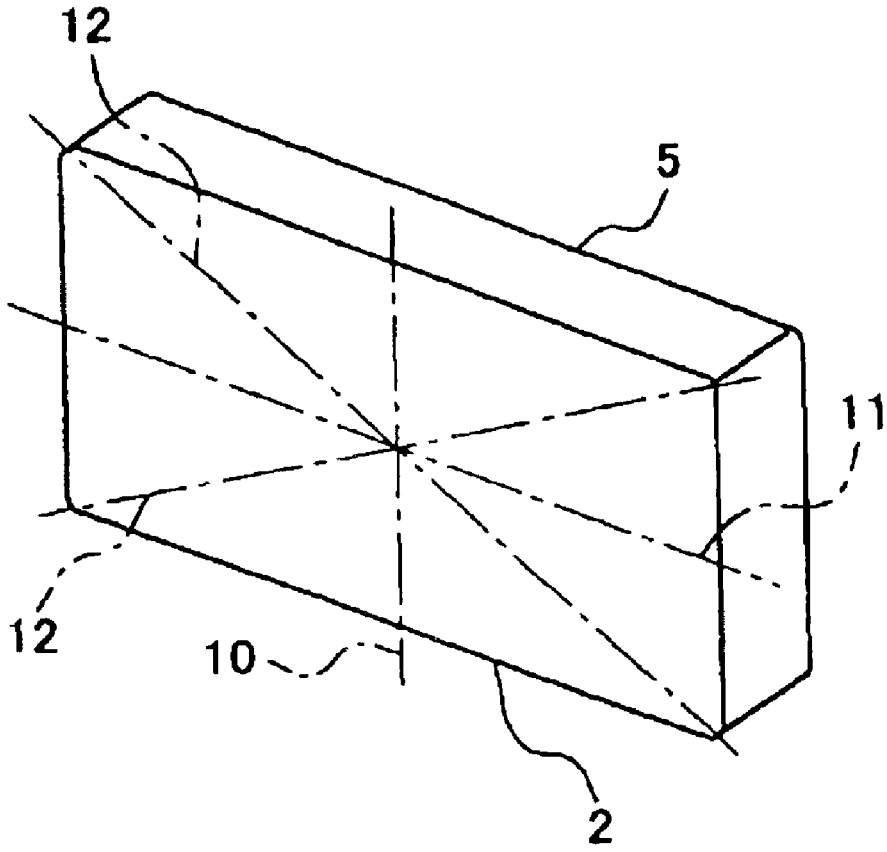
FIG. 3 is a diagram showing axes in a face portion of a panel in the cathode ray tube according to the embodiment of the present invention.

The panel 5 of the cathode ray tube 1 according to the present embodiment is used for a television receiver with an aspect ratio of 16:9 and a diagonal screen size of 76 cm, and the outer surface of the face portion 2 is flat, while the inner surface is curved. By defining a minor axis 10, a major axis 11, and a diagonal axis 12 of the face portion as shown in FIG. 3 (the minor axis 10, the major axis 11 and the diagonal axis 12 intersect at one point on the tube axis), the panel 5 has a thickness of 13.5 mm in the center of the face portion 2, 18 mm in the periphery of the minor axial direction, 22 mm in the periphery of the major axial direction, and 26 mm in the periphery of the diagonal axial direction. In addition, in this case, with respect to the curve of the inner surface, the curvature on the minor axis is larger than the curvature on the major axis.

Here, as shown in FIG. 1, the light transmittance ratio of the colored layer in the periphery of the direction of the minor axis 10 relative to the light transmittance of the colored layer in the center of the face portion 2 is 110%. When this light transmittance ratio in the periphery of the direction of the minor axis 10 is too high, the color darkness in the periphery of the minor axial direction is reduced too much with respect to the center. As a result, when watching the screen of the cathode ray tube, the impression that white images rise to the surface in the periphery of the minor axial direction is given, so that it is not desirable. The light transmittance ratio of the colored layer in the periphery of the direction of the minor axis 10 relative to the center of the face portion 2 preferably is determined in a range of 100% to 110% at most when scarcely colored glass is used for the panel material as in the present embodiment, or in a range of 100% to 120% at most when tinted glass that is slightly darker than the scarcely colored glass (an absorption coefficient k=0.04626) is used.

Figure 4:
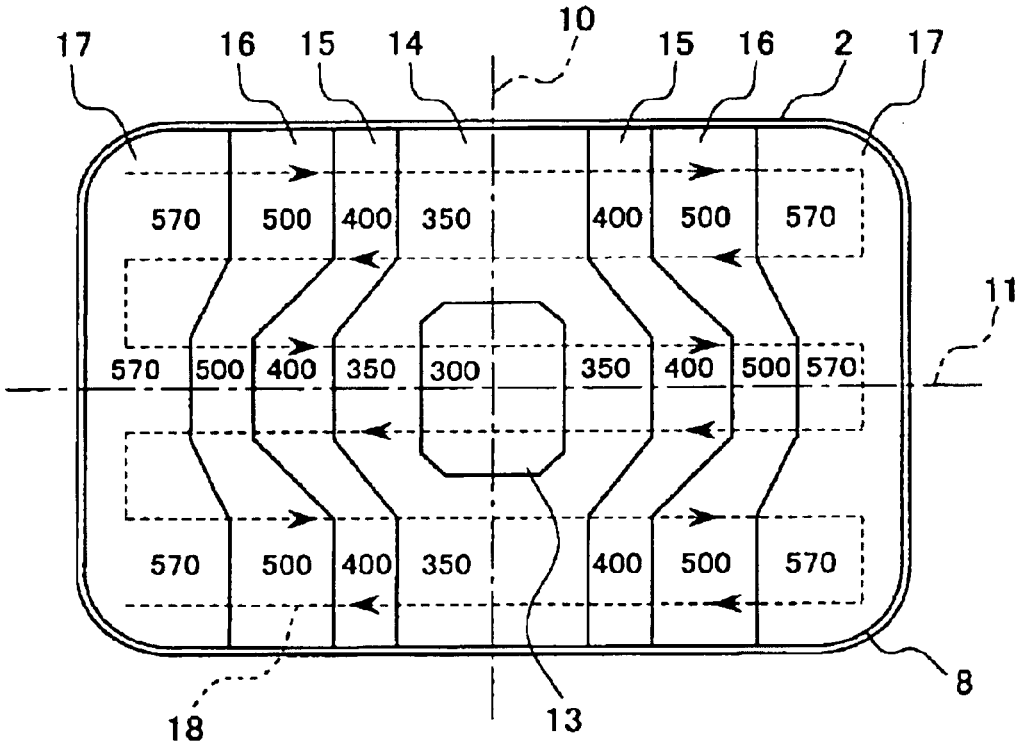
FIG. 4 is a distribution diagram of scanning speeds of a spray nozzle when applying a colored layer for the cathode ray tube according to the embodiment of the present invention.

In order to make the coloring layer have such a distribution of light transmittance, the travelling speed of the spray nozzle at the time of applying the coloring agent was changed depending on each place in the present embodiment. FIG. 4 shows the speed distribution of the spray nozzle in each position of the face portion 2, when the colored layer having the distribution of light transmittance ratios as shown in FIG. 1 is formed. Here, the numbers in the drawing show the travelling speed of the spray nozzle within the respective areas 13 to 17, and the unit thereof is millimeter per second. By changing the speed in this way, the density (the application quantity) of the coloring agent can be changed easily, so that the desired distribution of light transmittance can be obtained in the colored layer. In addition, the spray nozzle used here sprays the coloring agent in a quantity of 3 ml per minute under an air pressure of 0.4 MPa and is positioned at a height of about 200 mm above the outer surface of the face portion. Furthermore, the scanning direction of the spray nozzle is indicated as an exemplary model by a scanning line 18 shown by broken lines in FIG. 4, and the distance of the scanning line 18 in the direction of the minor axis 10 is determined to be 10 mm to 15 mm.

In order to confirm the effect of the surface treated cathode ray tube in the present embodiment described above, comparative evaluations were conducted by using (1) a cathode ray tube in which the panel is not provided with a colored layer (denoted as "cathode ray tube A"), (2) a cathode ray tube with a colored layer formed on the panel that allows the emission luminance of the cathode ray tube to be substantially equal (denoted as "cathode ray tube B"), and (3) a cathode ray tube shown in the present embodiment (denoted as "cathode ray tube C").

Figure 5A:
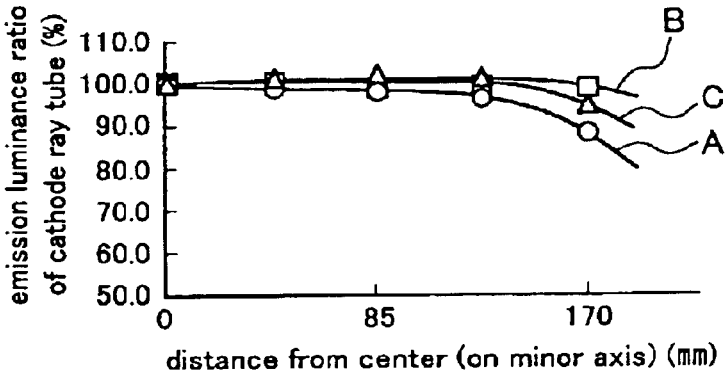
FIG. 5A, FIG. 5B and FIG. 5C are all graphs for comparing distributions of emission luminance ratios in the cathode ray tube according to the embodiment of the present invention with those in a conventional cathode ray tube.
Figure 5B:
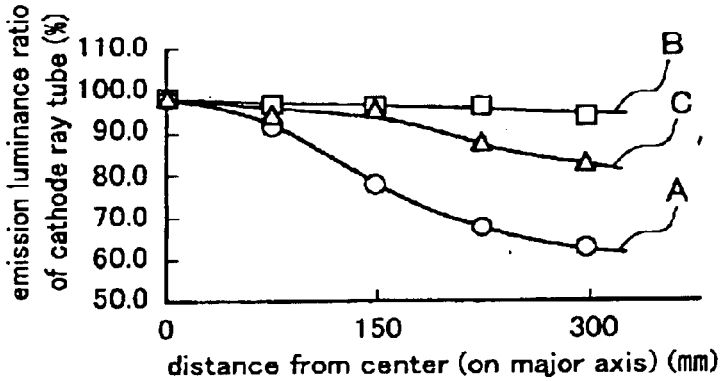
Figure 5C:
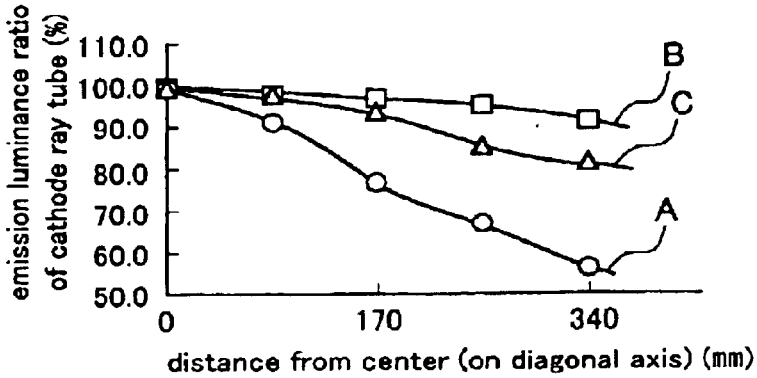
Figure 6A:
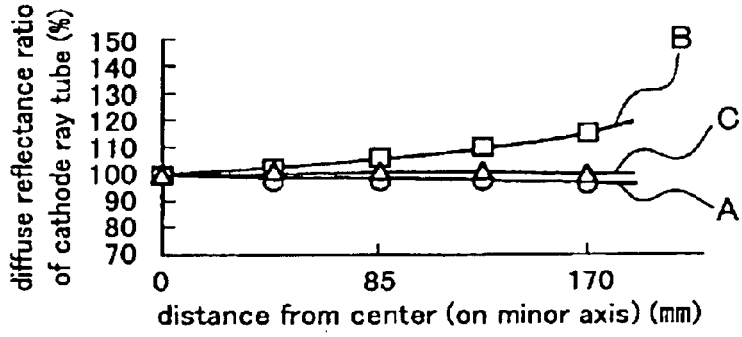
FIG. 6A, FIG. 6B and FIG. 6C are all graphs for comparing distributions of diffuse reflectance ratios in the cathode ray tube according to the embodiment of the present invention with those in the conventional cathode ray tube.
Figure 6B:
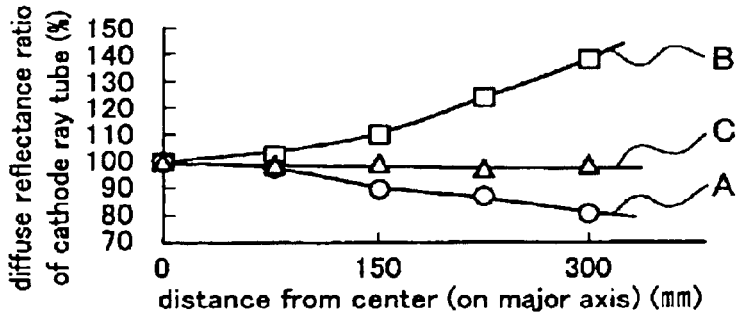
Figure 6C:
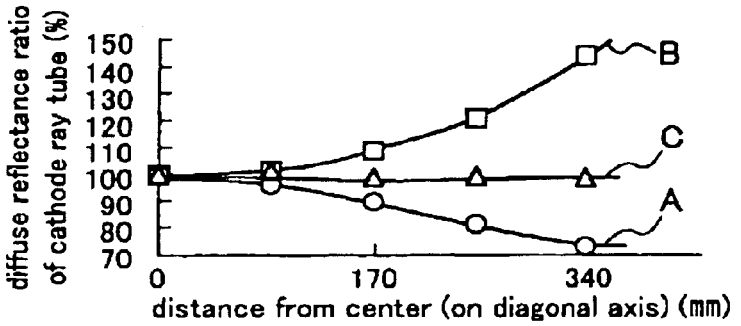

FIG. 5A to FIG. 5C show the distributions of the emission luminance ratios in the respective cathode ray tubes mentioned above. Furthermore, FIG. 6A to FIG. 6C show the distributions of the diffuse reflectance ratios (defined in Part 7, ISO 9241) in the respective cathode ray tubes mentioned above. The respective ratios of the measured values on minor axis are shown in FIG. 5A and FIG. 6A, those on the major axis are shown in FIG. 5B and FIG. 6B, and those on the diagonal axis are shown in FIG. 5C and FIG. 6C respectively. Moreover, the curved lines A to C correspond to the respective cathode ray tubes A to C.

With respect to the cathode ray tube A having no colored layer, the emission luminance is deteriorating from the central portion toward the periphery on all the axes, and due to its big difference, the images are darkened markedly in the periphery. Furthermore, with respect to the cathode ray tube B provided with the colored layer that allows the emission luminance of the cathode ray tube to be substantially equal, although the emission luminance is substantially the same in the entire area of the face portion, the diffuse reflectance has a big difference between the center and the periphery. When the diffuse reflectance has such a big difference between the center and the periphery, the unevenness in the difference between lightness and darkness or in the contrast of colors will be noticeable in fact even by visual observation. On the contrary, the cathode ray tube C exhibiting the present embodiment has an emission luminance ratio of 80% or higher at minimum relative to the center and a diffuse reflectance ratio of 95% at minimum relative to the center, which are levels at which the impression of evenness can be obtained sufficiently by visual observation, so that the difference in the luminance or the difference in the darkness and the contrast of colors is not perceived.

As a specific optimum range, it is preferable that the emission luminance ratio of the cathode ray tube is 75% or higher in the lowest part relative to the highest part, and that the diffuse reflectance ratio is 90% or higher in the lowest part relative to the highest part. Due to this configuration, it is possible to achieve a cathode ray tube from which the impression of evenness in the emission luminance and the contrast can be obtained naturally in the entire area of the face portion.

In addition, the present embodiment shows the colored layer in which the distribution of light transmittance changes stepwise (so-called digitally) for each area, as shown in FIG. 1. However, it is not limited to this configuration, and a colored layer in which the distribution of light transmittance changes gradually (so-called analogously) within each area of FIG. 1 may be used as well, and in this case, the aforementioned "boundary lines" will have the meaning of contour lines in a way. Furthermore, even with the colored layer in which the distribution of light transmittance changes stepwise for each area, the areas can be divided to be even narrower, so that the distribution of light transmittance can be regarded as a gradually changing distribution from a macroscopic viewpoint.

Furthermore, the present embodiment was explained by referring to the example in which the curvature on the minor axis is larger than the curvature on the major axis in the inner surface of the face portion. However, it is not limited to this configuration, and a cathode ray tube having a face portion, in which the curvature on the minor axis is larger than the curvature on the major axis, or the curvatures on both axes are substantially the same, may be used as well. Also in this case, the emission luminance and the diffuse reflectance ratio preferably satisfy the above-mentioned optimum ranges. In addition, also in this case, it is preferable that the light transmittance of the colored layer in the periphery is the same as or larger than that in the center.

Furthermore, in order to change the light transmittance of the colored layer, the travelling speed of the spray nozzle was determined to change depending on the place of the face portion in the present embodiment, but as an alternative, there is a method for changing the light transmittance by changing the distance between the spray nozzle and the outer surface of the face portion, that is, the height of the nozzle depending on the place. Besides, the application quantity from the spray nozzle may be changed depending on to the place.

In addition, two layers consisting of the first layer serving as the colored layer and the second layer serving as the silica layer to be hardened are formed on the outer surface of the face portion in the present embodiment, but it is not limited to this configuration. In the case where the strength of the layer can be maintained even with one layer of a colored layer, a single layer may be formed, or a plurality of colored layers may be formed.

Furthermore, the layers were formed in the face portion after the cathode ray tube was obtained in the form of a completed globe in the present embodiment, but the cathode ray tube may be assembled after forming the layers in advance in the face portion of the panel before assembling.

In addition, instead of applying the coloring agent directly to the face portion of the panel as in the present embodiment, the colored layer may be formed on a glass sheet by the technique used in the present embodiment, and this glass sheet may be glued on the face portion of the panel by using a resin etc.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a panel provided with a colored layer containing a coloring agent on an outer surface of a face portion, wherein the coloring agent has a density distribution such that a ratio of an emission luminance in a part that exhibits the lowest emission luminance to an emission luminance in a part that exhibits the highest emission luminance is not less than 75% and a ratio of a diffuse reflectance in a part that exhibits the lowest diffuse reflectance to a diffuse reflectance in a part that exhibits the highest diffuse reflectance is not less than 90%.

2. The cathode ray tube according to claim 1, wherein the coloring agent has a density distribution such that a light transmittance of the colored layer in a periphery of the face portion is the same as or larger than a light transmittance in a center.

3. The cathode ray tube according to claim 1, wherein the outer surface of the face portion is substantially flat and an inner surface thereof is curved, and the coloring agent has density distribution such that a light transmittance ratio of the colored layer is 100 to 120% in a peripheral portion on a minor axis of the face portion relative to a center.

4. The cathode ray tube according to claim 1, wherein a light transmittance contour line obtained by connecting points on the colored layer that have the same light transmittance is a convex form protruding from the center of the face portion toward the periphery of the face portion.

5. The cathode ray tube according to claim 4, wherein the light transmittance contour line is an approximately Ω letterform protruding from the center of the face portion toward the periphery of the face portion in a direction parallel with a major axis of the face portion.

6. A method for manufacturing the cathode ray tube according to claim 1, wherein the colored layer is allowed to have a distribution of light transmittance by changing an application quantity of a coloring agent.

7. The method for manufacturing the cathode ray tube according to claim 6, wherein the application quantity of the coloring agent is changed by changing an application speed.

8. The method for manufacturing the cathode ray tube according to claim 6, wherein the application quantity of the coloring agent is changed by changing a distance between the face portion and an application apparatus.

9. The method for manufacturing the cathode ray tube according to claim 6, wherein the application quantity of the coloring agent is changed by changing a spray quantity from an application apparatus.

* * * * *